US009017463B2

(12) United States Patent
Wei

(10) Patent No.: US 9,017,463 B2
(45) Date of Patent: Apr. 28, 2015

(54) COPPER PLATING SOLUTION AND METHOD FOR PREPARING THE SAME

(71) Applicant: BYD Company Limited, Shenzhen, Guangdong (CN)

(72) Inventor: Jialiang Wei, Guangdong (CN)

(73) Assignee: BYD Company Limited, Shenzhen, Guangdong (CN)

( * ) Notice: Subject to any disclaimer, the term of this patent is extended or adjusted under 35 U.S.C. 154(b) by 0 days.

(21) Appl. No.: 14/550,441

(22) Filed: Nov. 21, 2014

(65) Prior Publication Data

US 2015/0075405 A1 Mar. 19, 2015

Related U.S. Application Data

(63) Continuation of application No. PCT/CN2013/076043, filed on May 22, 2013.

(30) Foreign Application Priority Data

May 22, 2012 (CN) ..... 2012 1 0159428

(51) Int. Cl.
*C23C 18/40* (2006.01)
*C23C 18/54* (2006.01)

(52) U.S. Cl.
CPC ..... *C23C 18/405* (2013.01); *C23C 18/40* (2013.01); *C23C 18/54* (2013.01)

(58) Field of Classification Search
CPC ..... C23C 18/54; C23C 18/40; C23C 18/405
USPC ..... 106/1.23, 1.26
See application file for complete search history.

(56) References Cited

U.S. PATENT DOCUMENTS

| | | | | | |
|---|---|---|---|---|---|
| 2,849,351 | A * | 8/1958 | Haas et al. | ..... | 205/240 |
| 2,849,352 | A * | 8/1958 | Kirstahler et al. | ..... | 205/240 |
| 4,684,550 | A * | 8/1987 | Milius et al. | ..... | 106/1.23 |
| 4,877,450 | A * | 10/1989 | Brasch | ..... | 106/1.26 |
| 5,433,840 | A * | 7/1995 | Dahms et al. | ..... | 106/1.26 |
| 5,534,129 | A * | 7/1996 | Hoffacker et al. | ..... | 205/241 |
| 6,329,072 | B1 * | 12/2001 | Honma et al. | ..... | 106/1.26 |
| 6,607,653 | B1 * | 8/2003 | Tsuji et al. | ..... | 205/241 |
| 6,831,009 | B2 * | 12/2004 | Itabashi et al. | ..... | 438/672 |

FOREIGN PATENT DOCUMENTS

| | | | |
|---|---|---|---|
| CN | 87102861 | A | 12/1987 |
| CN | 1357647 | A | 7/2002 |
| CN | 1793426 | A | 6/2006 |
| CN | 101122016 | A | 2/2008 |
| CN | 101311306 | A | 11/2008 |
| CN | 101665962 | A | 3/2010 |
| CN | 102051606 | A | 5/2011 |
| CN | 102051607 | A | 5/2011 |
| CN | 102191491 | A | 9/2011 |
| EP | 0897998 | A2 | 2/1999 |
| JP | 2007-314857 | A | 12/2007 |
| WO | WO 98/37260 | A1 | 8/1998 |
| WO | WO 2013/174257 | A1 | 11/2013 |

OTHER PUBLICATIONS

PCT International Search Report and Written Opinion dated Sep. 5, 2013, issued in corresponding International Application No. PCT/CN2013/076043 (10 pages).

* cited by examiner

*Primary Examiner* — Helene Klemanski
(74) *Attorney, Agent, or Firm* — Finnegan, Henderson, Farabow, Garrett & Dunner, LLP

(57) ABSTRACT

A copper plating solution and a method for preparing a copper plating solution are provided. The copper plating solution comprises: a copper salt, a complexing agent, a stabilizer, a reducing agent, a surfactant, a hydroxyl-terminated polyoxypropylene ether, and a sodium trisulfide-isothiourea-propane sulfonate.

20 Claims, No Drawings

COPPER PLATING SOLUTION AND METHOD FOR PREPARING THE SAME

CROSS-REFERENCE TO RELATED APPLICATIONS

This application is a continuation of International Application No. PCT/CN2013/076043, filed on May 22, 2013, which claims priority to and benefits of Chinese Patent Application Serial No. 201210159428.1, filed with the State Intellectual Property Office of P. R. China on May 22, 2012, the entire contents of which are incorporated herein by reference in their entireties.

FIELD

The present disclosure relates to a field of electroless copper plating, and particularly relates to a copper plating solution and method for preparing the same.

BACKGROUND

The statements in this section merely provide background information related to the present disclosure and may not constitute prior art.

Since Brenner and Ridless first developed electroless copper plating technology in 1940s, this technology has been applied in various fields of national economy. Electroless copper plating plays an important role in electroless plating, and has been applied in various aspects such as the bottom layer of non-metallic plating, metallization of Printed Circuit Board (PCB) holes, and electromagnetic shielding layers of electronic instruments.

Copper plating solutions mainly comprise a copper salt, a reducing agent, a complexing agent, a stabilizer, a pH-modifier and other additives. The traditional copper plating solution has a poor stability, and can only be used at a low temperature, which would limit the activity and plating speed of electroless plating. Moreover, the plating has a poor quality, and the surface thereof is not compact enough.

Thus, there remains the need for improving copper plating solutions.

SUMMARY

In view thereof, the present disclosure seeks to solve at least one of the problems in the art. A copper plating solution is provided, which may have improved activity and stability. Further, a method for preparing the same is also provided.

In a first aspect of the present disclosure, a copper plating solution is provided. In some embodiments, the copper plating solution may comprise: a copper salt, a complexing agent, a stabilizer, a reducing agent, a surfactant, a hydroxyl-terminated polyoxypropylene ether, and a sodium trisulfide-isothiourea-propane sulfonate. Thus, with the copper plating solution described herein, by using the hydroxyl-terminated polyoxypropylene ether and the sodium trisulfide-isothiourea-propane sulfonate, which may act as a chemical reaction bridge to accelerate the transfer speed of electrons for the purpose of enhancing the catalytic activity of workpieces, the activity and the stability of the plating solution may be effectively improved, and electroless copper plating may be performed to form a compact surface of a copper layer more effectively.

According to some embodiments of the present disclosure, the copper plating solution may also comprise the following additional technical features:

According to an embodiment of the present disclosure, in the copper plating solution described herein, the copper salt may have a concentration ranging from about 5 g/L to about 20 g/L. In some embodiments, the hydroxyl-terminated polyoxypropylene ether may have a concentration ranging from about 5 g/L to about 30 g/L. In some embodiments, the sodium trisulfide-isothiourea-propane sulfonate may have a concentration ranging from about 0.001 g/L to about 0.05 g/L.

According to an embodiment of the present disclosure, the copper salt may comprise at least one selected from the group consisting of copper sulfate, copper chloride, and copper nitrate.

According to an embodiment of the present disclosure, the complexing agent may comprise at least one selected from the group consisting of ethylene diamine tetraacetic acid, a soluble salt of ethylene diamine tetraacetic acid, and potassium sodium tartrate.

According to an embodiment of the present disclosure, the stabilizer may comprise at least one selected from the group consisting of potassium ferrocyanate and bipyridyl.

According to an embodiment of the present disclosure, the reducing agent may comprise formaldehyde. According to an embodiment of the present disclosure, the surfactant may comprise sodium dodecyl sulfate.

According to a specific embodiment of the present disclosure, the copper plating solution may further comprise a pH-modifier. In some embodiments, the pH-modifier may comprise at least one selected from the group consisting of sodium hydroxide and potassium hydroxide.

According to an embodiment of the present disclosure, the copper plating solution may comprise copper sulfate, disodium ethylene diamine tetraacetic acid, potassium sodium tartrate, hydroxyl-terminated polyoxypropylene ether, sodium trisulfide-isothiourea-propane sulfonate, potassium ferrocyanate, bipyridyl, formaldehyde, sodium dodecyl sulphate, and sodium hydroxide.

According to an embodiment of the present disclosure, the copper plating solution comprises the disodium ethylene diamine tetraacetic acid at a concentration ranging from about 10 g/L to about 40 g/L, the potassium sodium tartrate at a concentration ranging from about 10 g/L to about 40 g/L, the potassium ferrocyanate at a concentration ranging from about 0.001 g/L to about 0.1 g/L, the bipyridyl at a concentration ranging from about 0.001 g/L to about 0.1 g/L, the formaldehyde at a concentration ranging from about 1 g/L to about 5 g/L, the sodium dodecyl sulphate at a concentration ranging from about 0.001 g/L to about 0.1 g/L, and the sodium hydroxide at a concentration ranging from about 5 g/L to about 20 g/L.

According to a second aspect of the present disclosure, a method for preparing a copper plating solution is provided. The method may comprise: a) mixing an aqueous solution of a copper salt with an aqueous solution of a complexing agent to obtain a first solution, and b) mixing the first solution with an aqueous solution of a stabilizer, an aqueous solution of a reducing agent, an aqueous solution of a surfactant, an aqueous solution of a hydroxyl-terminated polyoxypropylene ether, and an aqueous solution of a sodium trisulfide-isothiourea-propane sulfonate to obtain the copper plating solution. Thus, by using the method described herein, a plating solution with improved activity and stability may be obtained, and electroless copper plating may be performed to form a compact surface of a copper layer more effectively.

According to some embodiments of the present disclosure, the method for preparing the copper plating solution may also comprise the following additional technical features:

According to an embodiment of the present disclosure, the method for preparing the copper plating solution may further comprise adding a pH-modifier to the first solution prior to step b). In some embodiments, the pH-modifier may comprise at least one selected from the group consisting of sodium hydroxide and potassium hydroxide.

Additional aspects and advantages of embodiments of present disclosure will be given in part in the following descriptions, become apparent in part from the following descriptions, or be learned from the practice of the embodiments of the present disclosure.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

According to a first aspect of the present disclosure, a copper plating solution is provided. In some embodiments, the copper plating solution may comprise: a copper salt, a complexing agent, a stabilizer, a reducing agent, a surfactant, a hydroxyl-terminated polyoxypropylene ether, and a sodium trisulfide-isothiourea-propane sulfonate. Thus, with the copper plating solution described herein, by adding the hydroxyl-terminated polyoxypropylene ether and the sodium trisulfide-isothiourea-propane sulfonate in the solution, which may act as a chemical reaction bridge to accelerate the transfer speed of electrons for the purpose of enhancing the catalytic activity of workpieces, the activity and the stability of the plating solution may be effectively improved, and electroless copper plating may be performed to form a compact surface of a copper layer more effectively.

According to some embodiments of the present disclosure, the copper salt being the main salt in the copper plating solution has no special restrictions, and may include any forms of copper salts used by those skilled in the art, as long as providing enough Cu ions during the process of copper plating, reacting with the reducing agent to generate pure metal copper deposited on a workpiece surface to be plated, and forming a copper plating layer. In a specific embodiment of the present disclosure, the copper salt may comprise at least one selected from the group consisting of copper sulfate, copper chloride, and copper nitrate. According to one embodiment of the present disclosure, the copper sulfate may comprise $CuSO_4.5H_2O$. In addition, according to some embodiments of the present disclosure, the content of the copper salt in the copper plating solution has no special restrictions, and may comprise a content range used in the art. In a specific embodiment of the present disclosure, the copper salt may have a concentration ranging from about 5 g/L to about 20 g/L.

According to some embodiments of the present disclosure, the copper plating solution may comprise hydroxyl-terminated polyoxypropylene ether and sodium trisulfide-isothiourea-propane sulfonate. According to some embodiments of the present disclosure, the contents of the hydroxyl-terminated polyoxypropylene ether and the sodium trisulfide-isothiourea-propane sulfonate in the copper plating solution have no special restrictions, and may be a content range used in the art. In some embodiments of the present disclosure, the hydroxyl-terminated polyoxypropylene ether may have a concentration ranging from about 5 g/L to about 30 g/L. In some embodiments, the sodium trisulfide-isothiourea-propane sulfonate may have a concentration ranging from about 0.001 g/L to about 0.05 g/L. The hydroxyl-terminated polyoxypropylene ether may shield impurity ions in the plating solution and suppress side reactions of monovalent copper ions, and also may prevent copper particles from continuous reacting to grow by wrapping the wrap copper particles generated in the plating solution, which may ensure the quality of a copper plating layer. The sodium trisulfide-isothiourea-propane sulfonate may suppress various kinds of side reactions during the copper plating process, to ensure the long-term stability of the copper plating solution, and thus the activity and the stability of the plating solution may be effectively improved. Thus, with the copper plating solution described herein, by adding the hydroxyl-terminated polyoxypropylene ether and the sodium trisulfide-isothiourea-propane sulfonate in the solution, which may act as a chemical reaction bridge to accelerate the transfer speed of electrons for the purpose of enhancing the catalytic activity of workpieces, the activity and the stability of the plating solution may be effectively improved, and electroless copper plating may be performed to form a compact surface of a copper layer more effectively.

According to some embodiment of the present disclosure, the complexing agent in the copper plating solution has no special restrictions, and may be any complexing agent used in the art. In one specific embodiment of the present disclosure, the complexing agent may comprise at least one selected from the group consisting of ethylene diamine tetraacetic acid, a soluble salt of ethylene diamine tetraacetic acid, and potassium sodium tartrate. In some embodiments, the complexing agent may comprise double complexing components to improve the stability of the copper plating solution. In a specific embodiment of the present disclosure, the complexing agent may be a mixture of disodium ethylene diamine tetraacetic acid and potassium sodium tartrate. According to some embodiments of the present disclosure, the content of the complexing agent in the copper plating solution has no special restrictions, and may be a content range used in the art. In a specific embodiment of the present disclosure, the complexing agent may comprise the disodium ethylene diamine tetraacetic acid at a concentration ranging from about 10 g/L to about 40 g/L, and the potassium sodium tartrate at a concentration ranging from about 10 g/L to about 40 g/L. The complexing agent may prevent generation of a $Cu(OH)_2$ sediment when the $Cu^{2+}$ is subjected to an alkaline environment, even a highly alkaline environment, by forming a stable complex compound with $Cu^{2+}$. Meanwhile, the complexing agent may also prevent the copper from directly reacting with formaldehyde, which may result in the plating solution becoming invalid. Thus, the activity and the stability of the plating solution may be further improved, and electroless copper plating may be performed to form a compact surface of a copper layer more effectively.

According to some embodiments of the present disclosure, the stabilizer in the copper plating solution has no special restrictions, and may be any stabilizer used in the art. In one specific embodiment of the present disclosure, the stabilizer may comprise at least one selected from the group consisting of potassium ferrocyanate and bipyridyl. In an embodiment of the present disclosure, the stabilizer may comprise a mixture of potassium ferrocyanate and bipyridyl. According to some embodiments of the present disclosure, the content of the stabilizer in the copper plating solution has no special restrictions, and may be a content range used in the art. In a specific embodiment of the present disclosure, the stabilizer in the copper plating solution may comprise the potassium ferrocyanate at a concentration ranging from about 0.001 g/L to about 0.1 g/L, and the bipyridyl at a concentration ranging from about 0.001 g/L to about 0.1 g/L. The stabilizer of the present disclosure may improve the stability of the copper plating solution. Due to large difference between different stabilizers, in one embodiment of the present disclosure, the stabilizer may comprise multiple stabilizers to enhance advantages and avoid disadvantages, to maximally improve the stability of the copper plating solution of the present disclosure. Thus, the activity and the stability of the plating solution may be further improved, and electroless copper plating may be performed to form a compact surface of a copper layer more effectively.

According to some embodiments of the present disclosure, the reducing agent in the copper plating solution has no special restrictions, and it may be any reducing agent used in the art. In one specific embodiment of the present disclosure, the reducing agent may comprise formaldehyde. The formaldehyde may react with the $Cu^{2+}$ to generate deposited Cu atom, while the formaldehyde itself may be oxidized into a formic acid. According to an embodiment of the present disclosure, the formaldehyde has an excellent reducing capacity, and may autocatalyze to deposit copper selectively on an activated substrate surface. Thus, the activity and the stability of the plating solution may be further improved, and electroless copper plating may be performed to form a compact surface of a copper layer more effectively.

According to some embodiments of the present disclosure, the surfactant in the copper plating solution has no special restrictions, and it may be any surfactant used in the art. In one specific embodiment of the present disclosure, the surfactant may comprise sodium dodecyl sulfate. According to some embodiments of the present disclosure, the content of the surfactant in the copper plating solution has no special restrictions, and it may be a content range used in the art. In a specific embodiment of the present disclosure, the copper plating solution may comprise sodium dodecyl sulfate at a concentration ranging from about 0.001 g/L to about 0.1 g/L. The inventor of the present disclosure has found that the sodium dodecyl sulfate may slow down volatilization of formaldehyde, and may improve the quality of the plating layer. Thus, the activity and the stability of the plating solution may be further improved, and electroless copper plating may be performed to form a compact surface of a copper layer more effectively.

According to some embodiments of the present disclosure, the copper plating solution may further comprise a pH-modifier. According to some embodiments of the present disclosure, the pH-modifier in the copper plating solution has no special restrictions, and it may be any alkaline substance used in the art. In one specific embodiment of the present disclosure, the pH-modifier may comprise at least one selected from the group consisting of sodium hydroxide and potassium hydroxide. In some embodiments, the pH-modifier is sodium hydroxide. According to some embodiments of the present disclosure, the content of sodium hydroxide in the copper plating solution has no special restrictions, and it may be a content range used in the art. In a specific embodiment of the present disclosure, the copper plating solution may comprise sodium dodecyl sulfate at a concentration ranging from about 5 g/L to about 20 g/L. Because formaldehyde as the reducing agent in some embodiments may have the highest reducing capacity under an alkaline environment, the pH-modifier may ensure the copper plating solution of the present disclosure being an alkaline solution, which provides an alkaline environment for the electroless copper plating. Thus, the activity and the stability of the plating solution may be further improved, and electroless copper plating may be performed to form a compact surface of a copper layer more effectively.

In an embodiment of the present disclosure, the copper plating solution may comprise copper sulfate, disodium ethylene diamine tetraacetic acid, potassium sodium tartrate, hydroxyl-terminated polyoxypropylene ether, sodium trisulfide-isothiourea-propane sulfonate, potassium ferrocyanate, bipyridyl, formaldehyde, sodium dodecyl sulphate, and sodium hydroxide.

In a specific embodiments of the present disclosure, the copper plating solution may comprise the disodium ethylene diamine tetraacetic acid at a concentration ranging from about 10 g/L to about 40 g/L, the potassium sodium tartrate at a concentration ranging from about 10 g/L to about 40 g/L, the potassium ferrocyanate at a concentration ranging from about 0.001 g/L to about 0.1 g/L, the bipyridyl at a concentration ranging from about 0.001 g/L to about 0.1 g/L, the formaldehyde at a concentration ranging from about 1 g/L to about 5 g/L, the sodium dodecyl sulphate at a concentration ranging from about 0.001 g/L to about 0.1 g/L, the sodium hydroxide at a concentration ranging from about 5 g/L to about 20 g/L.

According to a second aspect of the present disclosure, a method for preparing a copper plating solution is provided. The method may comprise: a) mixing an aqueous solution of a copper salt with an aqueous solution of a complexing agent to obtain a first solution, and b) mixing the first solution with an aqueous solution of a stabilizer, an aqueous solution of a reducing agent, an aqueous solution of a surfactant, an aqueous solution of a hydroxyl-terminated polyoxypropylene ether, and an aqueous solution of a sodium trisulfide-isothiourea-propane sulfonate to obtain the copper plating solution. Thus, by using the method of according to the present disclosure, a plating solution with improved activity and stability may be obtained, and electroless copper plating may be performed to form a compact surface of a copper layer more effectively.

According to some embodiments of the present disclosure, the method for preparing the copper plating solution may further comprise adding a pH-modifier to the first solution prior to step b). According to some embodiments of the present disclosure, the pH-modifier in the copper plating solution has no special restrictions, and it may be any alkaline substance used in the art. In one specific embodiment of the present disclosure, the pH-modifier may comprise at least one selected from the group consisting of sodium hydroxide and potassium hydroxide. In some embodiments, the pH-modifier is sodium hydroxide. According to some embodiments of the present disclosure, the content of sodium hydroxide in the copper plating solution has no special restrictions, and it may be a content range used in the art. In a specific embodiment of the present disclosure, the copper plating solution may comprise sodium hydroxide at a concentration ranging from about 5 g/L to about 20 g/L. According to one embodiment of the present disclosure, the aqueous solution of the copper salt is mixed with the aqueous solution of the complexing agent to obtain the first solution, the pH-modifier is added into the above first solution, and the obtained solution is then mixed with the aqueous solution of the stabilizer, the aqueous solution of the reducing agent, the aqueous solution of the surfactant, the aqueous solution of the hydroxyl-terminated polyoxypropylene ether, and the aqueous solution of the sodium trisulfide-isothiourea-propane sulfonate to obtain the copper plating solution described herein. Because formaldehyde as the reducing agent in some embodiments may have the highest reducing capacity under an alkaline environment, the pH-modifier may ensure the copper plating solution of the present disclosure being an alkaline solution, which provides an alkaline environment for electroless copper plating. Thus, the activity and the stability of the plating solution may be further improved, and electroless copper plating may be performed to form a compact surface of a copper layer more effectively.

The disclosure will be further described below in way of examples. Raw materials used in Examples and Comparative Examples are all commercially available.

Examples 1-3

Three copper plating solutions S1-S3 were prepared according to the formula in Table 1. Specifically, each component shown in the table was dissolved in water to form separate aqueous solutions, then the aqueous solution of copper chloride was mixed with the aqueous solution of the complexing agent to form a first solution, and the aqueous solution of sodium hydroxide was added into the first solution to adjust pH to form a second solution. After stirring the second solution for 2 minutes, aqueous solutions of the other components were added into the second solution.

TABLE 1

| Component | S1 | S2 | S3 |
|---|---|---|---|
| copper sulfate pentahydrate | 15 g/l | 10 g/l | 15 g/l |
| disodium ethylene diamine tetraacetic acid | 25 g/l | 22 g/l | 10 g/l |
| potassium sodium tartrate | 15 g/l | 12 g/l | 10 g/l |
| hydroxyl-terminated polyoxypropylene ether | 20 g/l | 15 g/l | 4.5 g/l |
| sodium trisulfide-isothiourea-propane sulfonate | 0.01 g/l | 0.005 g/l | 0.001 g/l |
| sodium hydroxide | 12 g/l | 10 g/l | 5 g/l |
| formaldehyde | 4 g/l | 3.5 g/l | 1.5 g/l |
| potassium ferrocyanate | 0.01 g/l | 0.008 g/l | 0.11 g/l |
| bipyridyl | 0.01 g/l | 0.008 g/l | 0.0009 g/l |
| sodium dodecyl sulfate | 0.01 g/l | 0.008 g/l | 0.11 g/l |

Comparative Example 1

A comparative copper plating solution DS1 was prepared according to Example 1 in CN101122016A. The comparative copper plating solution DS1 comprised: 18 g/L of copper sulfate pentahydrate, 10 mg/L of formaldehyde, 15 g/L of disodium ethylene diamine tetraacetic acid, 10 mg/L of potassium ferrocyanate, and 16 g/L of sodium hydroxide.

Comparative Example 2

A comparative copper plating solution DS2 was prepared according to following formular. The comparative copper plating solution DS2 comprised: 15 g/L of copper sulfate pentahydrate, 25 g/L of disodium ethylene diamine tetraacetic acid, 15 g/L of potassium sodium tartrate, 0.01 g/L of sodium dodecyl sulfate, 12 g/L of sodium hydroxide, 4 g/L of formaldehyde, 0.01 g/L of potassium ferrocyanate, and 0.01 g/L of bipyridyl.

Comparative Example 3

A comparative copper plating solution DS3 was prepared according to following formula. The comparative copper plating solution DS3 comprised: 15 g/L of copper sulfate pentahydrate, 25 g/L of disodium ethylene diamine tetraacetic acid, 15 g/L of potassium sodium tartrate, 20 g/L of hydroxyl-terminated polyoxypropylene ether, 0.01 g/L of sodium dodecyl sulfate, 12 g/L of sodium hydroxide, 4 g/L of formaldehyde, 0.01 g/L of potassium ferrocyanate, and 0.01 g/L of bipyridyl.

Comparative Example 4

A comparative copper plating solution DS4 was prepared according to following formula. The comparative copper plating solution DS4 comprised: 15 g/L of copper sulfate pentahydrate, 25 g/L of disodium ethylene diamine tetraacetic acid, 15 g/L of potassium sodium tartrate, 0.005 g/L of sodium trisulfide-isothiourea-propane sulfonate, 0.01 g/L of sodium dodecyl sulfate, 12 g/L of sodium hydroxide, 4 g/L of formaldehyde, 0.01 g/L of potassium ferrocyanate, and 0.01 g/L of bipyridyl.

Performance Testing

A laser-activated DSM3730 series material was immersed in the copper plating solutions S1-53 and DS1-DS4, respectively, and then electroless plating was performed on the material for 3 hours at a temperature of about 50° C. Table 2 shows the plating effectiveness of Examples S1-S4 and Comparative Examples DS1-DS4.

TABLE 2

| Copper plating solution | Activity | Stability |
|---|---|---|
| DS1 | No plating | Decomposed by chemical solution after 1 hour |
| DS2 | 50% plating | Over-plating after 1 hour |
| DS3 | 100% plating, 45 mins | Over-plating after 2 hours |
| DS4 | 70% plating | Over-plating after 2.5 hours |
| S1 | 100% plating, 30 mins | No over-plating after 3 hours |
| S2 | 100% plating, 35 mins | No over-plating after 3 hours |
| S3 | 100% plating, 90 mins | No over-plating after 3 hours |

As shown in Table 2, the activity and stability of Example S1-S3 were notably improved by using the electroless copper plating described herein, which comprised the hydroxyl-terminated polyoxypropylene ether and the sodium trisulfide-isothiourea-propane sulfonate.

Reference throughout this specification to "an embodiment," "some embodiments," "one embodiment," "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment," "in an embodiment," "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A copper plating solution, comprising:

a copper salt, a complexing agent, a stabilizer, a reducing agent, a surfactant, a hydroxyl-terminated polyoxypropylene ether, and a sodium trisulfide-isothiourea-propane sulfonate.

2. The copper plating solution according to claim 1, wherein the copper salt has a concentration ranging from about 5 g/L to about 20 g/L.

3. The copper plating solution according to claim 1, wherein the hydroxyl-terminated polyoxypropylene ether has a concentration ranging from about 5 g/L to about 30 g/L.

4. The copper plating solution according to claim 1, wherein the sodium trisulfide-isothiourea-propane sulfonate has a concentration ranging from about 0.001 g/L to about 0.05 g/L.

5. The copper plating solution according to claim 1, wherein the copper salt comprises at least one selected from the group consisting of copper sulfate, copper chloride, and copper nitrate.

6. The copper plating solution according to claim 5, wherein the copper salt comprises $CuSO_4.5H_2O$.

7. The copper plating solution according to claim 1, wherein the complexing agent comprises at least one selected from the group consisting of ethylene diamine tetraacetic acid, a soluble salt of ethylene diamine tetraacetic acid, and potassium sodium tartrate.

8. The copper plating solution according to claim 7, wherein the complexing agent comprises disodium ethylene diamine tetraacetic acid and potassium sodium tartrate.

9. The copper plating solution according to claim 1, wherein the stabilizer comprises at least one selected from the group consisting of potassium ferrocyanate and bipyridyl.

10. The copper plating solution according to claim 9, wherein the stabilizer comprises potassium ferrocyanate and bipyridyl.

11. The copper plating solution according to claim 1, wherein the reducing agent comprises formaldehyde.

12. The copper plating solution according to claim 1, wherein the surfactant comprises sodium dodecyl sulfate.

13. The copper plating solution according to claim 1, further comprising a pH-modifier.

14. The copper plating solution according to claim 13, wherein the pH-modifier comprises at least one selected from the group consisting of sodium hydroxide and potassium hydroxide.

15. The copper plating solution according to claim 14, wherein the pH-modifier comprises sodium hydroxide.

16. The copper plating solution according to claim 1, wherein the copper plating solution comprises copper sulfate, disodium ethylene diamine tetraacetic acid, potassium sodium tartrate, hydroxyl-terminated polyoxypropylene ether, sodium trisulfide-isothiourea-propane sulfonate, potassium ferrocyanate, bipyridyl, formaldehyde, sodium dodecyl sulphate, and sodium hydroxide.

17. The copper plating solution according to claim 16, wherein the disodium ethylene diamine tetraacetic acid has a concentration ranging from about 10 g/L to about 40 g/L, the potassium sodium tartrate has a concentration ranging from about 10 g/L to about 40 g/L, the potassium ferrocyanate has a concentration ranging from about 0.001 g/L to about 0.1 g/L, the bipyridyl has a concentration ranging from about 0.001 g/L to about 0.1 g/L, the formaldehyde has a concentration ranging from about 1 g/L to about 5 g/L, the sodium dodecyl sulphate has a concentration ranging from about 0.001 g/L to about 0.1 g/L, and the sodium hydroxide has a concentration ranging from about 5 g/L to about 20 g/L.

18. A method for preparing a copper plating solution, comprising:

a) mixing an aqueous solution of a copper salt with an aqueous solution of a complexing agent to obtain a first solution, and b) mixing the first solution with an aqueous solution of a stabilizer, an aqueous solution of a reducing agent, an aqueous solution of a surfactant, an aqueous solution of a hydroxyl-terminated polyoxypropylene ether, and an aqueous solution of a sodium trisulfide-isothiourea-propane sulfonate to obtain the copper plating solution.

19. The method according to claim 18, further comprising adding a pH-modifier to the first solution prior to step b).

20. The method according to claim 19, wherein the pH-modifier comprises at least one selected from a group consisting of sodium hydroxide and potassium hydroxide.

* * * * *